United States Patent [19]

Laby

[11] 4,178,718

[45] Dec. 18, 1979

[54] DOOR ASSEMBLY FOR A TUB AND SHOWER ENCLOSURE

[75] Inventor: Jordan M. Laby, Sherman Oaks, Calif.

[73] Assignee: American Shower Door Co., Inc., Santa Monica, Calif.

[21] Appl. No.: 876,646

[22] Filed: Feb. 10, 1978

[51] Int. Cl.[2] ..... E05D 13/02

[52] U.S. Cl. ..... 49/411; 49/460

[58] Field of Search ..... 49/411, 410, 409, 412, 49/413, 460; 16/87 R, 93 R

[56] References Cited

U.S. PATENT DOCUMENTS

| | | | |
|---|---|---|---|
| 2,754,535 | 7/1956 | Plemeng | 49/411 X |
| 2,909,802 | 10/1959 | Gang et al. | 49/411 X |
| 2,980,969 | 4/1961 | Tinfow | 49/411 |
| 3,130,456 | 4/1964 | Migneault et al. | 49/413 X |
| 3,295,259 | 1/1967 | Dallaire | 49/413 |
| 3,310,914 | 3/1967 | De Klavon | 49/411 X |
| 3,350,739 | 11/1967 | Rifkin | 49/411 X |
| 3,384,998 | 5/1968 | Abramson | 49/411 |
| 3,787,936 | 1/1974 | Rystad | 49/411 X |

*Primary Examiner*—Philip C. Kannan

*Attorney, Agent, or Firm*—Wm. Jacquet Gribble

[57] ABSTRACT

A pair of roller and track suspended glass doors is assembled with a tub or shower enclosure without drilling or piercing the door panels. Compression clamps depending from the rollers grip the upper edge of each panel. Adhesive pads support combined handles and towel bars on obverse and reverse side of alternate panels. A central bottom guide track is snapped into and adhesively secured to the bottom frame member. The bottom frame member includes a upright outside flange with an inwardly extending rubbing bar to preclude outer panel abrasion. End guides for the inner door panel are fixed to upright side members of the frame. The upright members support the frame header which contains the top track for the rollers and may be contoured to accept a trim panel on the outer face thereof.

2 Claims, 7 Drawing Figures

Fig. 1.
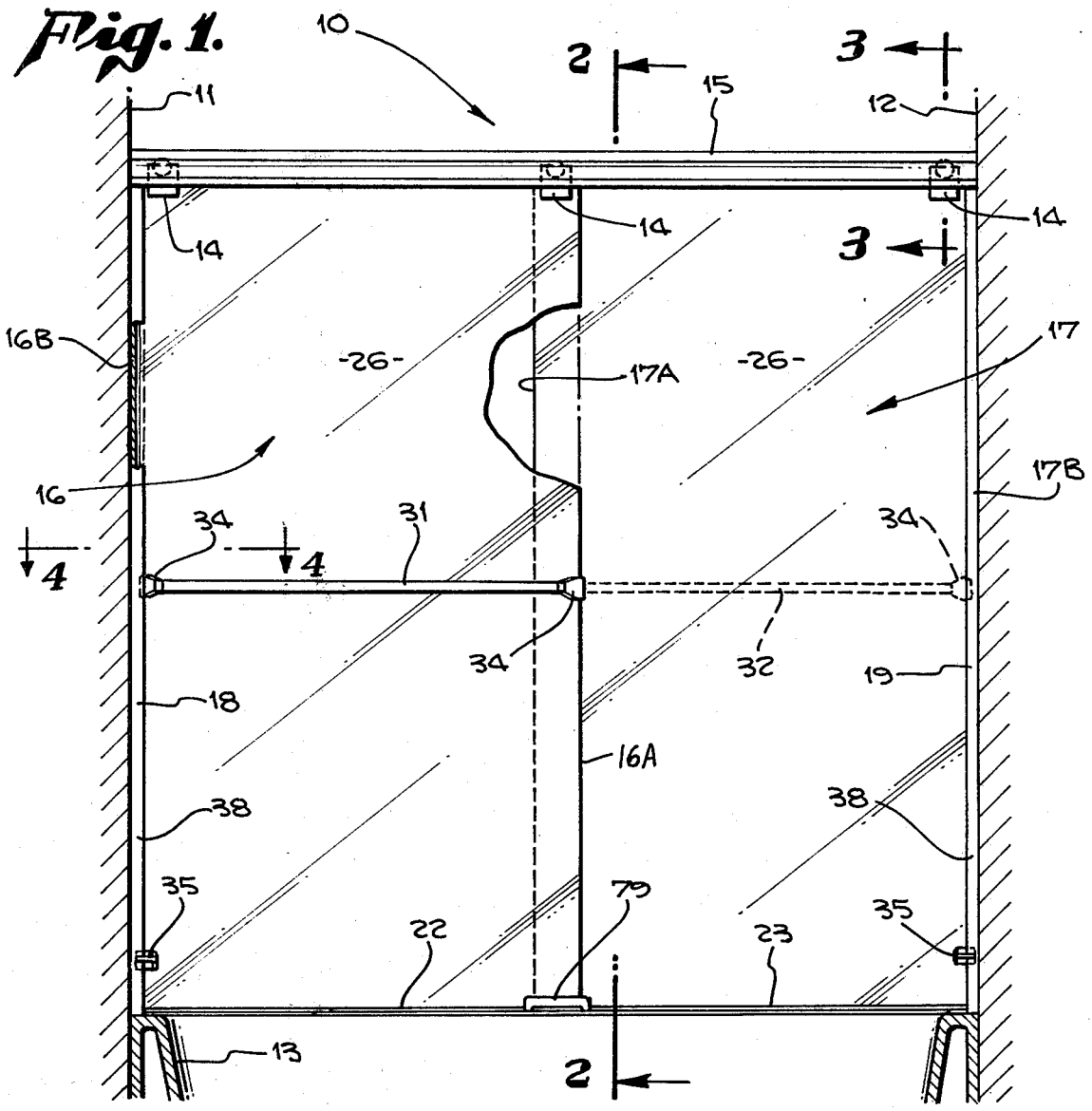
Fig. 4.
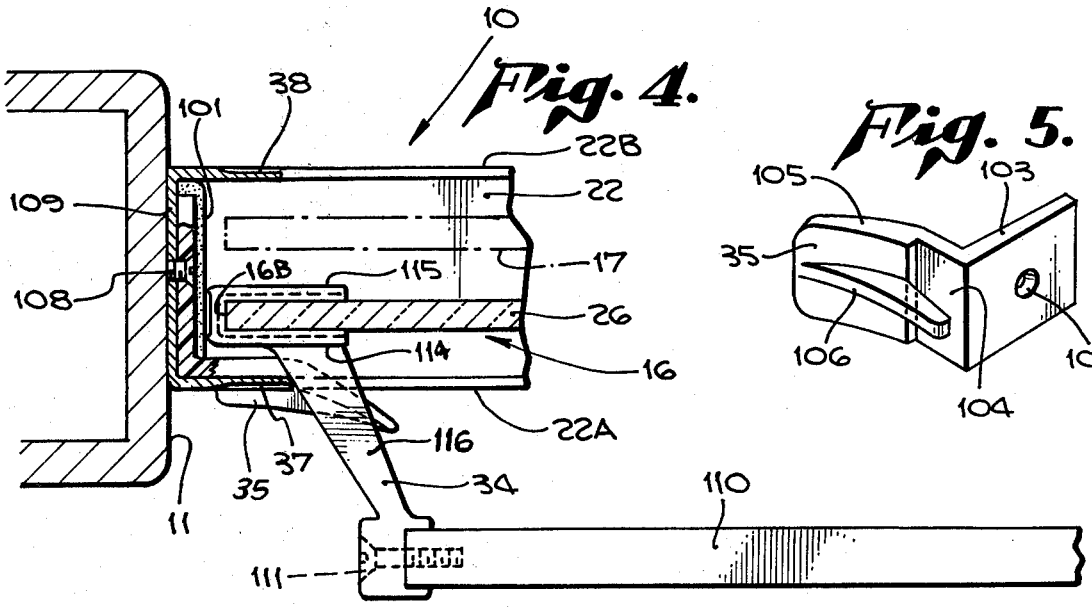
Fig. 5.

DOOR ASSEMBLY FOR A TUB AND SHOWER ENCLOSURE

BACKGROUND OF THE INVENTION

The invention relates to sliding closure panels for enclosures and more particularly to closure panels for tub and shower enclosures. The field of the invention is exemplified in part by my previously issued U.S. Pat. No. 3,852,916 "entitled Sliding Door Assembly" issued Dec. 10, 1974.

Most conventional tub and shower closure panels of the sliding or hinged type are of tempered glass for a water barrier, light transmission and cleansing ease. A problem with such glass panels is fragility. Therefore, panels are conventional framed with aluminum or other non-corrosive metals. However, such panel frames are expensive, so many panels are now frameless, but pierced, notched or otherwise cut out to receive hanging hardware and fittings such as handles and towel racks. Piercing and notching, however, produce stress areas which induce early fracturing of the glass panels, shortening useful life of the panel.

The present invention utilizes a unique combination of top and bottom supports and guides with compression grippers and adhesive pads to lessen materially the stress imposed upon tempered glass panels at the points of support for both the panels and panel accessories. Adhesive layers are utilized between the gripping surfaces of the gripper attachments and the panel not only to secure the compressing members in place with respect to the panels but also to act as a shock absorbing buffer between the grippers and the panel.

SUMMARY OF THE INVENTION

The invention contemplates a sliding door assembly for use with top and bottom horizontal tracks which extend in between spaced vertical uprights and comprises one or more unpierced movable door panels each of which is defined by four edges and obverse and reverse faces. Panel support rollers engage the top track, with compression or clamp means securing a support roller to the door panel. A central bottom panel guide for the free bottom panel edges has a lesser horizontal extent than the bottom horizontal track and is secured to the track by means of protrusions fitting into horizontal slots in the track. In a preferred embodiment of the invention towel bars which also act as handles are secured to each movable panel by spaced apart holder ends with the bar extending between the holder ends. Each of the holder ends has flanges engaging each face of the door panel by means of double faced adhesive sheets intervening between the flanges and the door panel faces.

In the preferred embodiment each support roller for an unpierced door panel comprises a first clamp bar with a downward gripper leg and an upper clamp body with a second clamp bar which has a downward gripper leg and upper clamp body with a fulcrum ridge which protrudes toward the first clamp bar and compression means which impinges on each of the clamp bars at a zone removed from the fulcrum ridge and adjacent the edge of the panel. A roller holder extends from the first clamp bar upper bar body to journal a roller which engages the top horizontal track.

The invention thus provides easily moved tub or shower door panels which may be translucent, transparent or opaque and which move within a water-tight frame without unduly stressing the panels at the points of attachment of the varying support members. Several manufacturing steps inherent in conventional support systems are obviated by the invention with the resultant lowered cost for fabrication.

These and other advantages of the invention are apparent from the following detailed description and of the drawing.

BRIEF DESCRIPTION OF THE DRAWING

FIG. 1 is an elevational view of the inside of a sliding door assembly in accordance with the invention, partly broken away;

FIG. 4 is a fragmentary plan view taken along line 4—4 of FIG. 1;

FIG. 5 is a perspective view of a panel end guide for the inside panel of the invention;

DESCRIPTION OF THE PREFERRED EMBODIMENT

Figure 2:
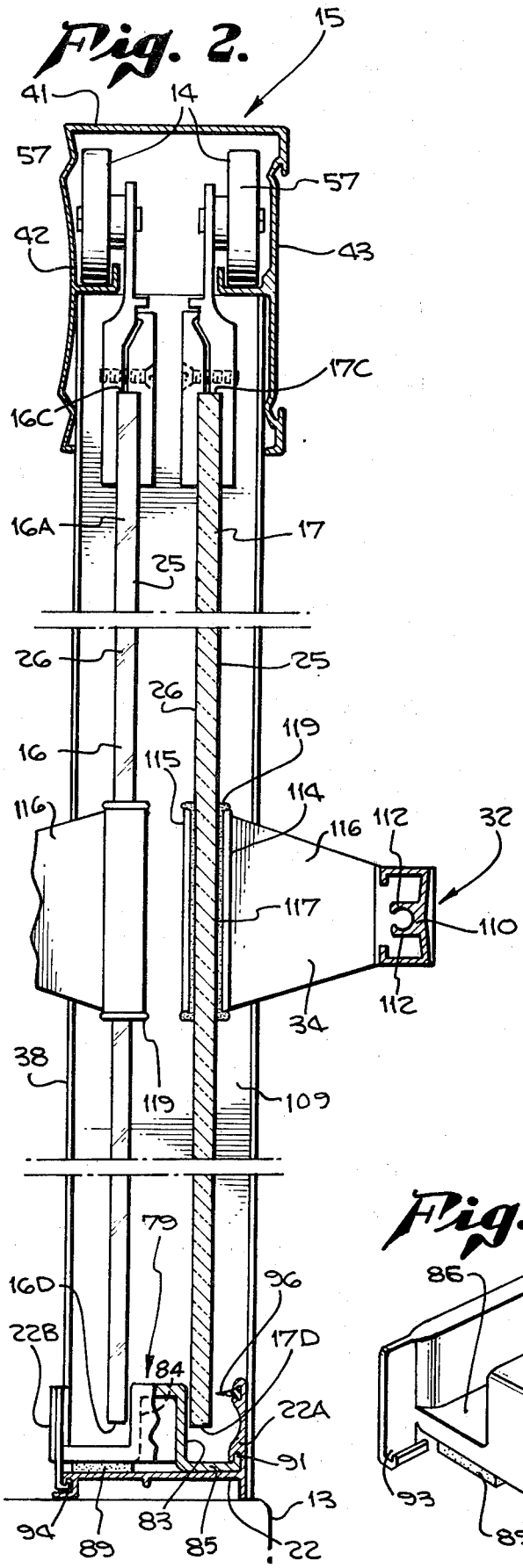
FIG. 2 is a transverse sectional elevation taken along line 2—2 of FIG. 1.
Figure 3:
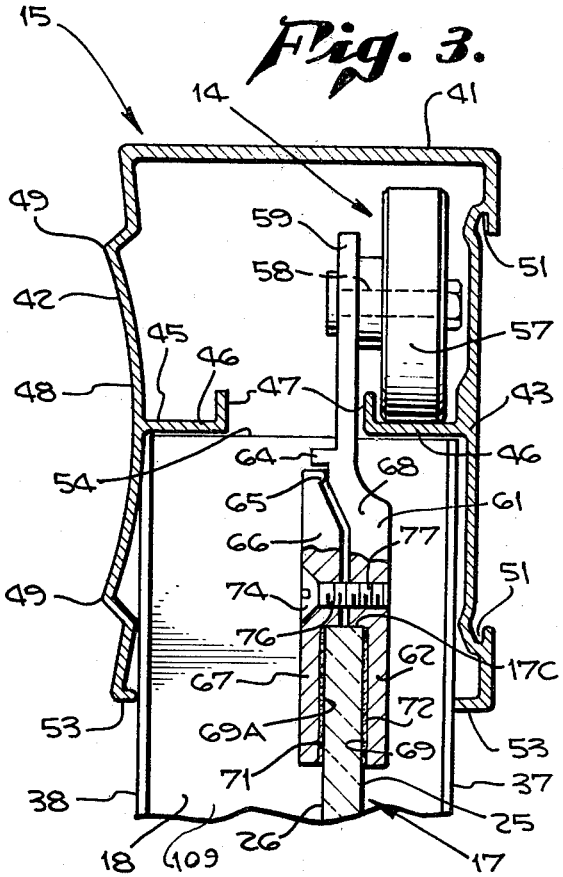
FIG. 3 is a fragmentary transverse sectional elevation to a larger scale taken along line 3—3 of FIG. 1.

In FIGS. 1 through 4 a sliding door assembly 10 for an enclosure is shown in place between the vertical uprights 11 and 12 of an opening above a conventional bath tub 13, shown fragmentarily in FIGS. 1 and 2. In FIG. 1, which is a view from inside the enclosure, a plurality of roller assemblies 14 engages a horizontal top frame header 15 to support door panels 16 and 17, panel 16 being the inner door panel. Vertical frame members 18 and 19 are secured to the opening uprights 11 and 12 respectively, and rise from a bottom horizontal track 22 which is secured to an upper rim 23 of the tub in conventional fashion by a water-proof adhesive or caulk (not shown).

In FIG. 1 each of the door panels can be seen to have respectively an inner vertical edge 16A, 17A and an outer vertical edge 16B, 17B. The door panels are further defined respectively by upper edges 16C, 17C and bottom edges 16D, 17D. Each panel further has an obverse face 25 and a reverse face 26, the obverse faces being the outer faces of the panels with respect to the enclosure.

Figure 6:
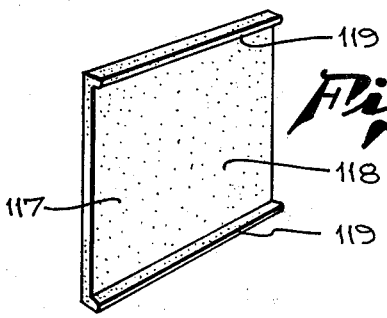
FIG. 6 is a perspective view of an adhesive pad used in conjunction with the towel bar holders of the invention.

Each door panel 16,17 has a combined hanger and handle 31,32 respectively fixed to the respective door panels by longitudinally spaced holder ends 34 to be described later in more detail with respect to FIGS. 2,4, and 6. Hanger bar 31 extends inwardly from panel 16 with respect to the enclosure and hanger bar 32 extends outwardly from panel 17.

The panels are relatively unconfined at their bottom edges 16D,17D, having some freedom of motion between parallel longitudinal horizontal flanges 22A, 22B of bottom track 22. It is therefore desirable that end guides such as the guides 35 shown attached to vertical uprights 18 and 19 in FIG. 1 provide guidance for the inner panel's travel from one side of the enclosure to the other along the interior track to preclude contact between edges 16A,16B and flanges 37,38 of vertical uprights 18 and 19.

The header 15 supported between the uprights 18 and 19 has the general cross-sectional configuration of an inverted U. A top web 41 extends transversely between downwardly depending flanges 42,43, flange 42 being the inner flange. Each flange has an inwardly protruding, longitudinally extending track. Flange 42 has a track 45 with a track beam 46 and a track lip 47 inwardly of the flange. Flange 43 has a similar track beam 46 and lip 47.

One or both of the header flanges may be ornamentally configured. In the illustrative embodiment flange 42 has an inward longitudinal shallow concavity 48 terminating vertically in parallel spaced ridges 49 for a pleasing artistic aspect. Flange 43 is configured to have vertically opening grooves 51 spaced vertically on the flange to accommodate insertable trim strips (not shown) which may be placed in the grooves prior to header assembly in the opening. Such decorative strips may be embossed, anodized or otherwise decorated to suit the decor of the room in which the sliding door panels are installed. Each header flange terminates downwardly in an inwardly protruding lip 53 which bears against the flanges 37,38 of the uprights such that the header is securely lodged with the bottom portion of its track beams 46 resting on an upper edge 54 of each upright.

Each roller assembly 14 has one or more rollers 57 pivotally mounted by a transverse bolt 58 in a vertical extending roller holder 59 extending upwardly from a first clamp bar 61 which has a downwardly depending gripper leg 62 which is stepped to engage the unpierced panel such as the panels 16, and 17. The clamp bar has an inwardly extending rib 64 which affords a stop for the longitudinal and protruding fulcrum bead 65 of a second clamp bar 66 which has an indented gripper leg 67 depending from the second clamp bar. The framing members, including the header, may be of 6063 aluminum stock, but 6061T5 stock is preferred for the roller assembly.

Preferably, the roller holder is vertically centered above the door panel and therefore first clamp bar 61 has an off-set section 68 to put the clamping faces 69,69A of the clamp bars parallel to the center plane of the panel thickness.

Adhesive sheets 71,72 such as those made by 3M Company and which are preferably adhesive coated on both sides intervene between the gripper legs and the panel. The clamp bars are then drawn together about the panel by a compression screw 74 which is lodged in a clearance hole 76 of the second clamping bar and threadably engaged in an aligned threaded hole 77 of the first clamp bar. The door panel edge 17C is thus effectively secured to the roller assembly by the compression grip of the clamp bars and by the adhesive bond of the adhesive sheets 71,72 without localized stressing of the panel at the point of support.

In the preferred embodiment two roller assemblies 14 are used at the top of each closure panel. In other closure assemblies it may be desired to use three or more assemblies.

Figure 7:
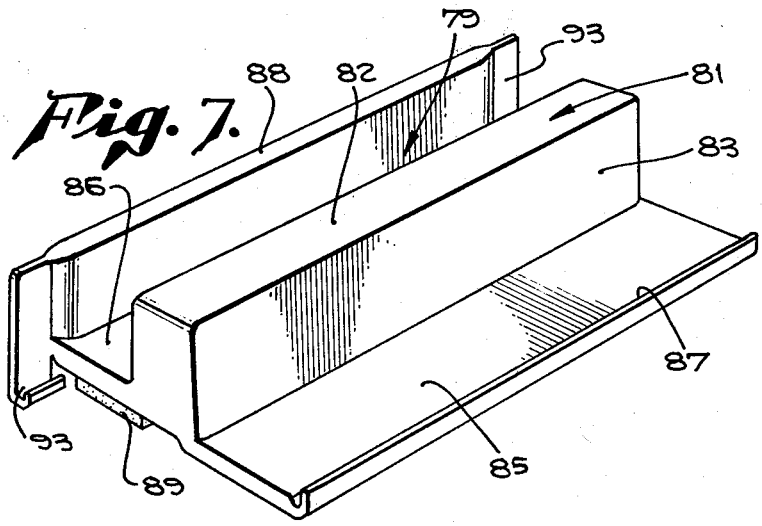
FIG. 7 is a perspective view of a central panel bottom guide for attachment to the bottom horizontal track. In the various Figures, like parts are identified by like reference numerals.

To lessen friction and thus ease the motion of the door panels along the upper tracks the rollers are slightly narrower than the tracks. The panels hang freely from the flange tracks and have limited freedom at their bottom edges 16D, 17D. In order to accommodate both the mounting flanges of the hanger bars 31,32 and the clamp bars 61,66 a transverse spacing is maintained between the obverse and reverse faces of the passing panels. The spacing is maintained in part by a central bottom track panel guide 79 which is indicated in FIG. 1 and shown in more detail in FIGS. 2 and 7. The panel has a middle hollow prism 81 with a top wall 82 and parallel side walls 83,84. Sidewall 83 abuts reverse face 26 of panel 17 and sidewall 84 abuts obverse face 25 of panel 16.

Transverse flanges 85,86 extend from the walls 83,84 respectively. Flange 85 terminates in an upward locking bead 87 and flange 86 terminates in an upwardly extending inner wall 88. Inspection of FIGS. 2 and 7 will show that flange 86 is stepped upwardly from flange 85 such that the two flanges are not coplanar, although parallel. Upward displacement of flange 86 provides space for a double faced foam adhesive strip 89 which adheres to the bottom of flange 86 and to the top of bottom track 22. Fixing of panel guide 79 is further assured by the engagement of locking bead 87 in a bottom track longitudinal groove 91 and by the interlock between resilient locking flanges 93 at each end of guide inner wall 88, which snap into a downwardly opening groove 94 in the inner wall 22B of the bottom track.

The central bottom track panel guide 79 is further secured at the mid-point of the longitudinal extent of the bottom track by first engaging locking bead 87 with track groove 91 and then pressing the inner wall 88 downwardly until double faced adhesive strip 89 adheres to the bottom track web and the locking flanges 93 snap into the track groove 94.

The longitudinal extent of the bottom track guide is such that a part of the bottom edges of both panels 16 and 17 are in contact with the central bottom track guide at all times. Such a contact precludes harmful contact between the panels. A plastic non-abrasive lip 96 extending inwardly from outer bottom track flange 22A contacts outer panel face 26 of panel 17 and aids confinement of water spray. The lip also acts as a resilient buffer as the outer panel 17 moves back and forth within the bottom track.

As can be seen from FIG. 4, the vertical panel edges are further guarded against impact by transverse buffer pads like pad 101 extending in the space between flanges 37,38 of the upright 18. A similar buffer pad (not shown) is located on upright 19.

The previously mentioned inside guides 35 are also secured to the uprights 18,19 as shown in FIGS. 1 and 4. Each guide has a mounting base 103 from which a right angle step 104 extends to connect with an angled buffer guide 105. A strengthening rib 106 is fixed to step 104 and angle guide 105 to insure the stability of the inner guide. An aperture 107 in the mounting base affords passage to a fastener such as a screw 108 of FIG. 4 which is threadably engaged in a web 109 of the flanges 18 and 19.

The hanger bars 31 and 32, which also act as handles for moving the door panels, each comprise a longitudinally extending hanger beam 110 extending between the holder ends 34 and attach thereto conventionally by screws 111 extending into the extruded beam inner spaced flanges 112. Each hanger bar holder end 34 has a pair of transversely spaced parallel mounting flanges 114,115 which are spaced slightly more than the thickness of the panel. The flanges extend vertically from angled bar arm 116. A folded vinyle doublefaced adhesive insert 117, shown unfolded in FIG. 6, has a body 118 which is substantially planar and upper and lower flanges 119 spaced apart approximately the vertical extend of metal mounting flanges 114,115. The flanges augment the holding power of the adhesive faces of the insert 117 which is applied to each of the panel edges 17A, 17B and 16A, 16B, after which the holder ends 34 are pressed onto the panels about the inserts 117. Thus, there is both an adhesive and a compressive bond between the holder ends and the door panels.

As can be appreciated from FIG. 4, holder ends 34 are first to contact the buffer strips 101 when the panels are moved, and the contact shock is additionally absorbed by the adhesive inserts 117.

It is evident from the illustrative embodiment that the assembly of the components is aided by the adhesive sheets both where support assemblies are attached to the door panel and where the central guide is attached to the bottom track. In the case of the holder ends of the hanger bars the bond between the panels and the holder ends is a compression fit aided by the adhesive insert and the supporting flanges 119 thereof. In the case of the support roller assembly a mechanical compression which can be adjusted is achieved by a lever arm effect from the fulcrum ridge 65 to the compression screw 74 intermediate the gripping surfaces of the gripper legs 62,67. The invention therefore provides considerably reduced local stress at the points of support on the door panels which are generally of frangible glass, and provides an efficient and economical manner for assembly of a closure mechanism with a free moving closure that is low in friction, easily maintained and assembled without special tools.

Embodiments other than the illustrative embodiment disclosed herein and variations thereof within the scope of the invention may occur to those skilled in this particular art. It is therefore desired that the invention be measured by the appended claims rather than by the illustrative disclosure made herein.

I claim:

1. A sliding door assembly for use with top and bottom horizontal guide tracks extending between spaced vertical uprights and comprising at least one unpierced movable door panel defined by four edges and obverse and reverse faces; a door panel support roller engaging the top guide track, clamp means securing a support roller to the door panel, a central bottom track panel guide, means securing said bottom track panel guide to the bottom track centrally thereof; a horizontal article holder on said movable panel comprised of a pair of spaced holder ends, a bar extending between said holder ends spaced from a face of said door panel, each of said holder ends having parallel mounting flanges on each face of said door panel; a binding laminate comprising a plastic sheet, an adhesive on obverse and reverse faces of said sheet, and protruding shoulders on each of the upper and lower peripheries of said sheet, said shoulders contacting said mounting flanges in support relationship thereto; said binding laminate intervening between said flanges and said door panel faces and compressed therebetween because of the small dimensional difference between panel thickness and flange separations.

2. A sliding door assembly for use with top and bottom horizontal guide tracks extending between spaced vertical uprights and comprising at least one unpierced movable door panel defined by four edges and obverse and reverse faces; a door panel support roller engaging the top guide track, clamp means securing a support roller to the door panel, a central bottom track panel guide having an upturned inner wall, a middle upward prism, a connector transverse flange extending between the prism and the inner wall, a second connector transverse flange extending from said prism opposite said first connector transverse flange, a locking bead on said second transverse flange remote from said prism, and resilient hooks at opposite ends of said inner wall extending to said bottom track; said resilient hooks and said locking bead engaging said bottom track to secure said central bottom track guide in place; a vertical step between the connector transverse flange and the second connector transverse flange, and a double faced adhesive sheet secured to the under surface of the uppermost connector transverse flange and to a horizontal surface of the bottom track.

* * * * *